US006425847B1

(12) United States Patent
Broenstrup

(10) Patent No.: US 6,425,847 B1
(45) Date of Patent: Jul. 30, 2002

(54) METHOD FOR PRODUCING A PACKING MATERIAL FROM PLASTIC FILM OR A SIMILAR WELDABLE MATERIAL

(75) Inventor: Volker Broenstrup, Lengerich (DE)

(73) Assignee: Klaus Reinhold Maschinen-und Geraetebau GmbH, Lengerich (DE)

( * ) Notice: Subject to any disclaimer, the term of this patent is extended or adjusted under 35 U.S.C. 154(b) by 0 days.

(21) Appl. No.: 09/520,330

(22) Filed: Mar. 7, 2000

(30) Foreign Application Priority Data

Mar. 8, 1999 (DE) ..... 199 10 264

(51) Int. Cl.[7] ..... B31B 23/36

(52) U.S. Cl. ..... 493/231; 493/243; 493/186; 493/189; 493/197; 493/210; 493/231

(58) Field of Search ..... 493/186, 189, 493/194, 197, 199, 200, 205, 210, 231, 243, 374, 379

(56) References Cited

U.S. PATENT DOCUMENTS 3,805,683 A * 4/1974 Hook ..... 271/197
4,551,125 A * 11/1985 Pezzana et al. ..... 493/194
4,655,737 A * 4/1987 Benoit ..... 493/194
4,913,693 A * 4/1990 Ball et al. ..... 493/194
6,149,565 A * 11/2000 Meyer et al. ..... 493/11
6,319,184 B1 * 11/2001 DeMatteis et al. ..... 493/186
6,339,911 B2 * 1/2002 Bois ..... 493/231
6,343,455 B2 * 2/2002 Bois ..... 53/128.1

* cited by examiner

*Primary Examiner*—Rinaldi I. Rada
*Assistant Examiner*—Gloria R Weeks
(74) *Attorney, Agent, or Firm*—Jordan and Hamburg LLP

(57) ABSTRACT

In the case of a method for producing a packing material from plastic film or a similar weldable material in the form of a bag or sack with side folds, the front and rear walls, as well as the side walls are formed from separate sections of material, which are connected with one another by welded seams. The material sections of the front wall and the rear wall are formed from a first and a second flat main sheet of material which, after a mutual overlapping is brought about, are conveyed in a first, common conveying direction. A third flat sheet of material is folded into a web with side folds, severed from the sections with side folds at a specified length and conveyed in a second direction transversely to the first conveying direction and placed upon one of the two main sheets of material. The bottom of the bag or sack in turn is formed by a separate material section of a fourth flat material sheet, which is brought together with at least one of the two main sheets of material, then conveyed parallel to the first conveying direction and welded together with the sections having the side walls as well as with the two main sheets of material along their adjoining side edges.

35 Claims, 5 Drawing Sheets

METHOD FOR PRODUCING A PACKING MATERIAL FROM PLASTIC FILM OR A SIMILAR WELDABLE MATERIAL

BACKGROUND OF THE INVENTION

The invention relates to a method for producing a packing material from plastic film or a similar weldable material in the form of a bag or sack with side folds and a front and rear wall, which are connected at their two sides by side folds forming the side wall, and with a bottom, which, in turn, is connected with the front and rear walls as well as with the side folds, the front wall and the rear wall as well as the side walls in each case being formed from separate sections of material, which are connected together by welded seams.

Packing materials of the given type from plastic film or similar weldable material are known in numerous embodiments, which depend on the use, to which they are to be put, for example, as beverage bags, as refillable packages for liquid or pasty materials or generally as butt-ended bags for pourable materials of any type. Compared to such packing materials in the form of bags or sacks with side folds, which are formed from a single section of material, packing materials in the form of bags or sacks with side folds, for which the front and rear walls as well as the side walls in each case are formed from separate sections of material, offer greater freedom with respect to the design possibilities of the individual sections of material, particularly with regard to the printing of the packing material with sales-promoting information, information about goods and the like, as well as with regard to the length dimensions of the side folds forming the side walls, which need not necessarily be the same as the length or height of the packing material but, depending on the configuration of the head of the packing material corresponding to the use for which the packing material is to be put, can also be shorter than the height of the packing material or of unequal dimensions at the two sides of the packing material.

SUMMARY OF THE INVENTION

It is therefore an object of the invention to provide a method for producing a packing material from plastic film or a similar weldable material in the form of a bag or sack with side folds of the initially given type. Furthermore, it shall be possible to carry out the method simply and in a continuous process.

Pursuant to the invention, this objective is accomplished owing to the fact that material sections of the front wall and the rear wall are formed from a first and a second flat main sheet of material which, after a mutual overlapping is brought about, are conveyed in a first, common conveying direction, a third flat sheet of material is folded into a web with a side fold, severed from the side fold sections at a specified length and conveyed in a second direction transversely to the first conveying direction while resting on one of the two main sheets of material and that the bottom of the sack in turn is formed by a separate section of material of a fourth flat sheet of material, which is brought together with at least one of the two main sheets of material, then conveyed parallel to the first conveying direction and welded together with the side-fold sections as well as the two main sheets of material along their adjoining side edges. The possibility exists here of printing all the sheets of material, which are used in the inventive method, in continuous printing processes and to meet the length requirements of the side fold sections, forming the side walls, these requirements depending on the intended use for the packing material, as well as of using sheets of material, supplied continuously for the inventive method, a prerequisite for a continuous process, for which the individual steps of the method can be carried out with the material on a conveyor belt, until finally individual packing materials are severed from the sheets of material being worked on at the end of the process.

Numerous further distinguishing features and advantages of the invention arise out of the dependent claims and the description below of two examples of the inventive method, in conjunction with the accompanying drawings.

DESCRIPTION OF THE PREFERRED EMBODIMENTS

As weldable material in the inventive method for producing packing materials, especially films of suitable polyolefins, such as polyethylene or polypropylene or also composite films are used, into which metal foil, especially aluminum foil, can be included, for example, for producing an aroma-tight packing material. Such weldable or heat-sealable materials are conventionally used for the production of packing materials.

Figure 1A:
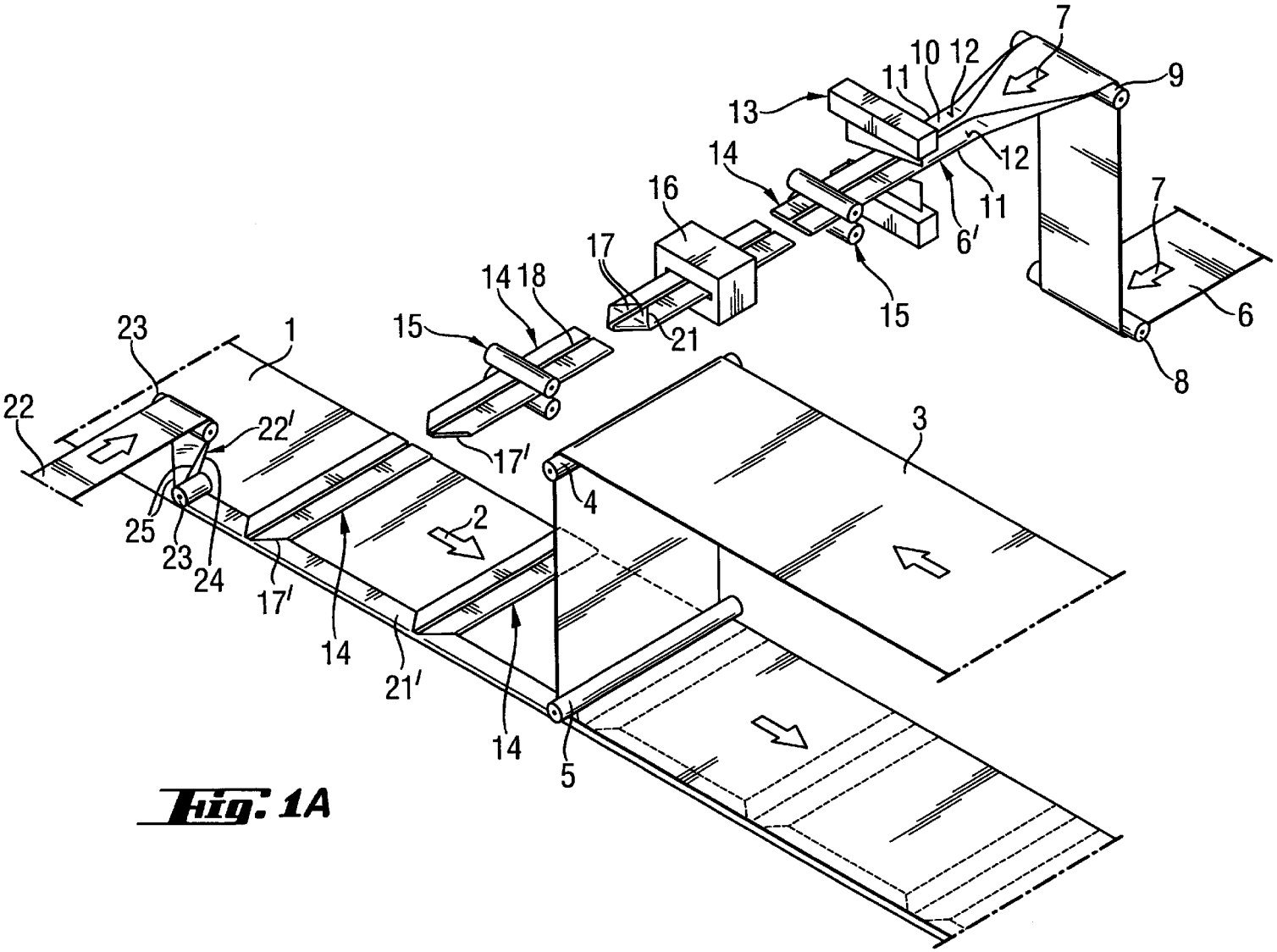
FIGS. 1A and 1B show a diagrammatic, perspective representation of an apparatus for producing a packing material from plastic film or similar weldable material in the form of a bag or sack with side folds according to a first embodiment of the inventive method, FIG. 1B representing an extension of FIG. 1A, FIGS. 2 to 5 show each show a diagrammatic perspective representation of a section with two side folds, used for producing the side walls of the packing material, in different processing stages, FIGS. 6 and 7 diagrammatically show perspective representations of the bottom of the bag or sack of the packing material, produced by the inventive method, in the empty state and in the filled state.

As is evident, to begin with, from FIG. 1A, a first flat main sheet of material 1 is conveyed in the direction of arrow 2 through a device, the details of which are not shown and which produces a packing material from plastic film or a similar weldable material, which receives the shape of a bag or sack with side folds in the course of the inventive method. A second flat main sheet of material 3 is conveyed from an upper plane about idle rollers 4 and 5 downward, covering the main sheet of material 1, whereupon both sheets of material 2 and 3, lying flat on top of one another, are conveyed jointly in the direction 2.

A third flat sheet of material 6 is conveyed in the direction of arrow 7 transversely, preferably at right angles, to the conveying direction 2 to the main sheet of material 1. In so doing, the sheet of material 6 is conveyed from a lower conveying plane about idle rollers 8 and 9 into an upper conveying plane, which occupies the same plane as the main sheet of material 1. In this upper conveying plane, the sheet of material 6 is folded into a side-fold web; in the case of the example shown, the side-fold web actually is a web 10 with two side folds in the form of a flat tube 6' with mutually opposite, lateral folded edges 11. The side parts 12 of the sheet of material 6, folded along the two folded edges 11 oppositely to one another into the flat tube 6', adjoin one another in the region of the vertical longitudinal center plane of the flat tube 6' preferably without overlapping and without being connected.

From the web 10 with the two side folds, sections 14 with two side folds are severed as flat tubular sections by means of a transverse cutting device 13 consisting of an upper tool and a lower tool, and conveyed by suitable means, which comprise at least a pair of rollers 15, through which the section 14 passes with fixation of its folded edges 11, to and through folding device 16. In the folding device 16, each section 14, at its leading end in the conveying direction 7, is folded in the form of double tucked-in triangles 17, the hypotenuses 21 of the right angled, equilateral triangles of which face one another in a parallel, opposite alignment.

Figure 2:
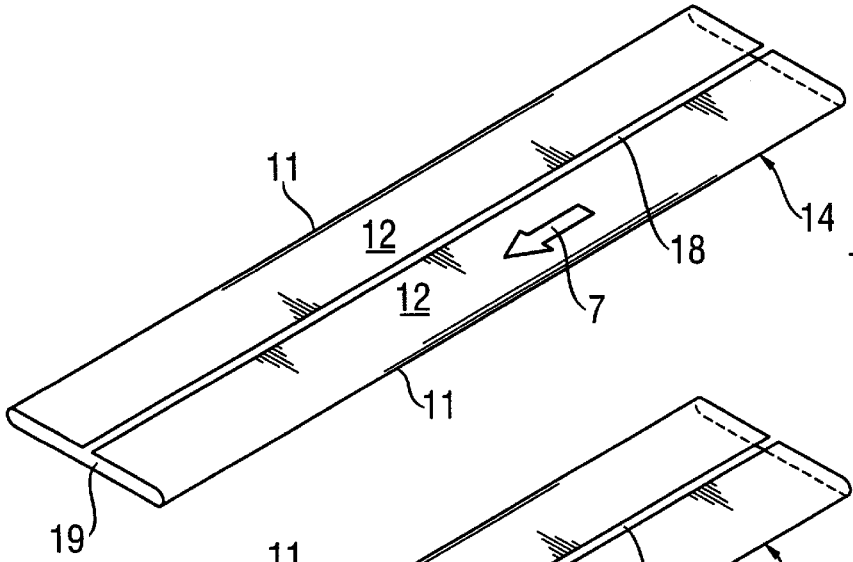

FIGS. 2 to 5 show the sections 14 on an enlarged scale. Their conveying direction once again is indicated by the directional arrow 7. FIG. 2 shows the section 14 directly after it is severed from the flat tube 6'. The region between the side parts 12, in which there is no overlapping and there are no connections, can be seen in the form of a longitudinal gap 18 at 18.

Figure 3:
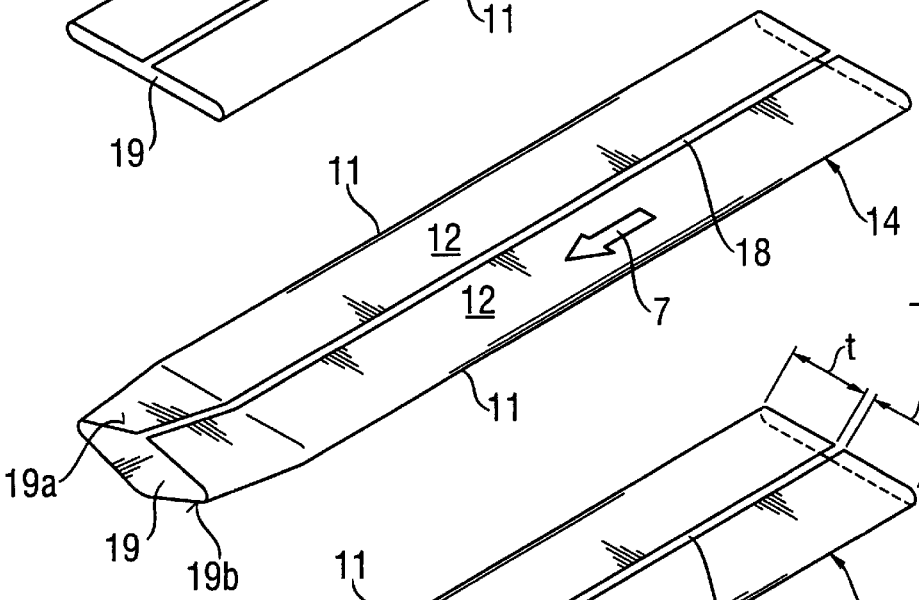
Figure 4:
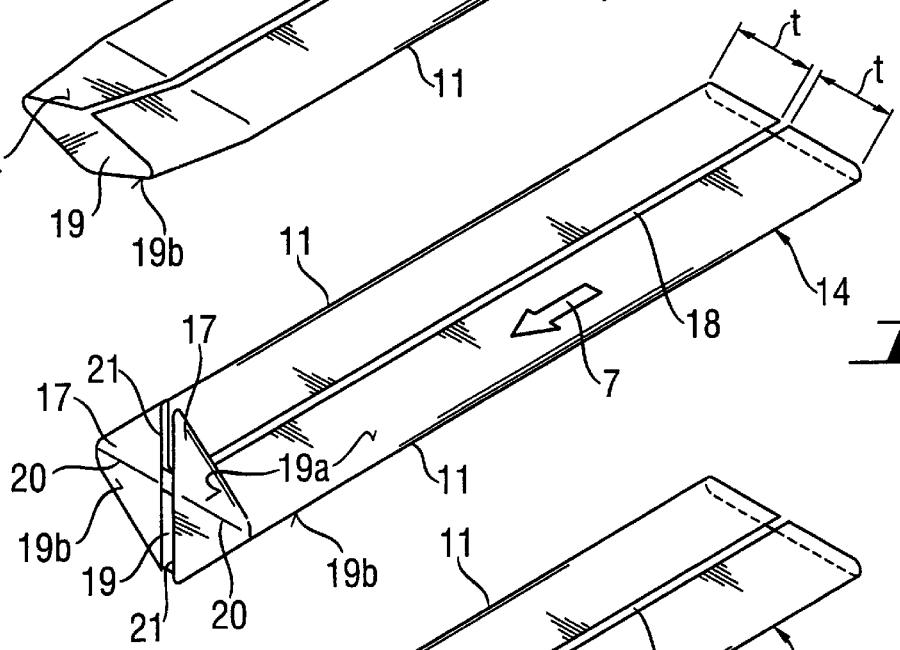

In the folding apparatus, as can be seen in FIG. 3, the end 19, which is the leading end, is unfolded at the upper side 19*a* and the underside 19*b* of the section 14 and, as shown in FIG. 4, it is folded laterally inwards and folded back about a transverse folding line 20 onto the upper side 19*a*. The distance of the transverse folding line 20 from the leading end 19 of the section 14 is equal to the depth t of a side fold or to half the width of the flat tube 6' and the two tucked-in corners 17 are formed in the shape of right angled, equilateral triangles, the hypotenuses 21 of which, at the end of the folding process, extend parallel to one another and to the longitudinally folded edges 11 of the section 14.

Figure 5:
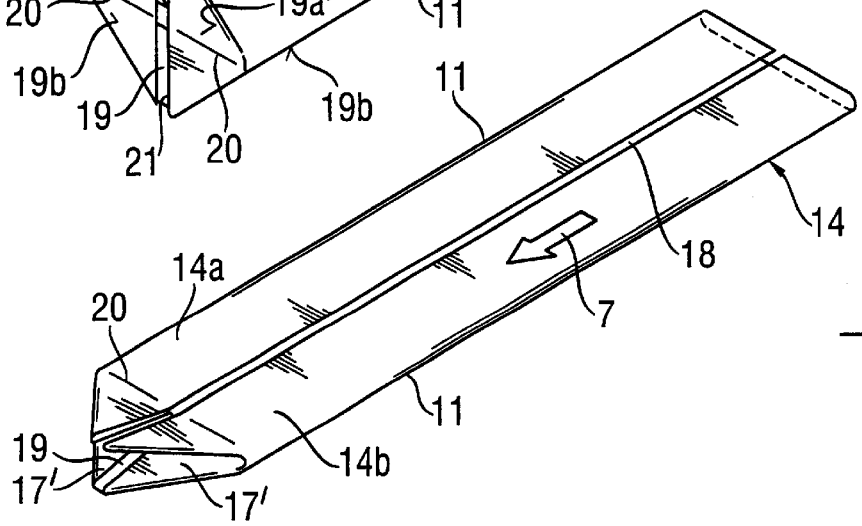
Figure 6:
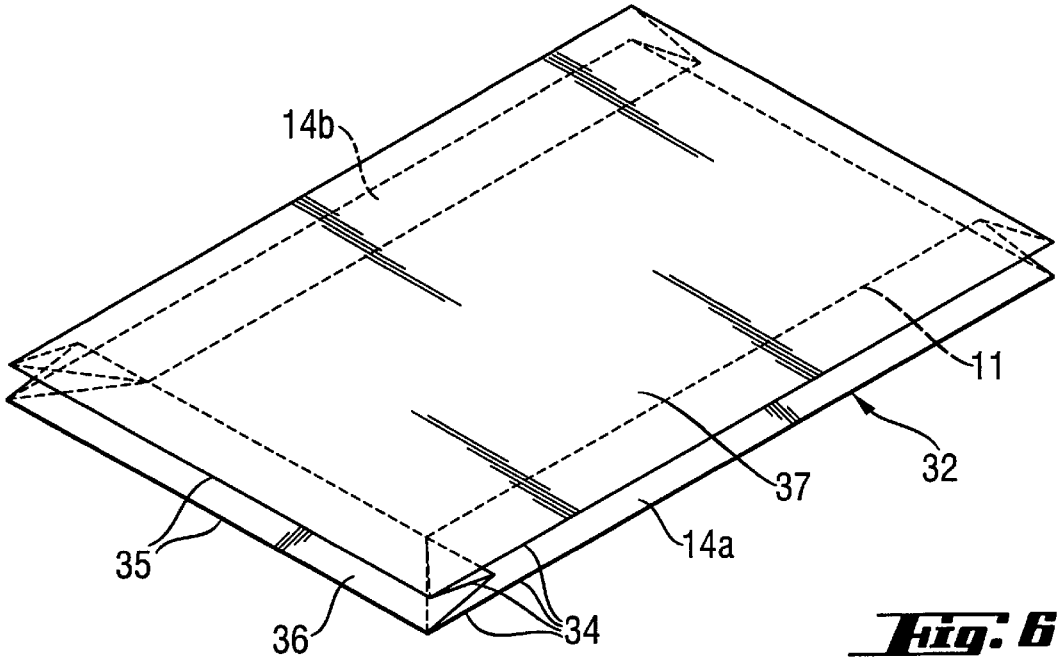
Figure 7:
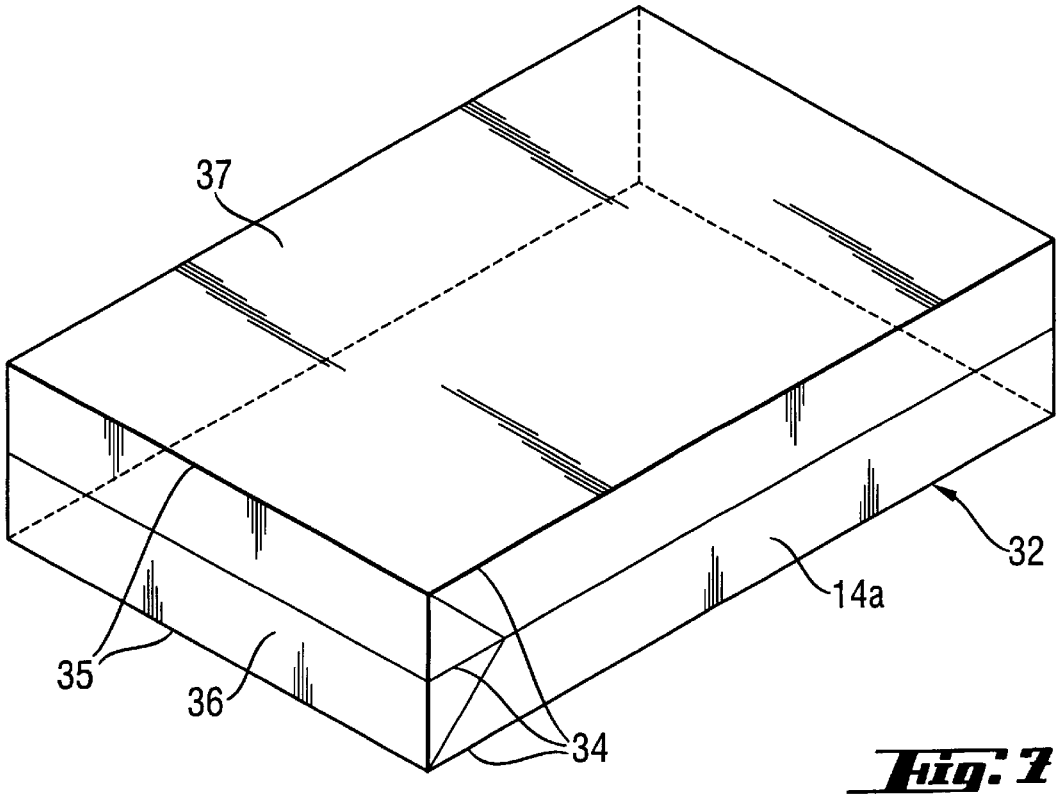

For the duration of the continued conveying of the sections 14, during which at least one further pair of rollers 15 is traversed, the tucked-in corner triangles 17 are folded back onto themselves along the transverse folding line 20, which defines the height of the respective tucked-in corner triangle 17, so that a triangular pocket 17', open in the conveying direction 7, is formed by each tucked-in corner triangle 17, as can be seen particularly from FIG. 5.

In this state, the section. 14 is placed onto the material sheet 1 as lower sheet and optionally attached to this with its underside 19*b* along its vertical, longitudinal center plane, containing the longitudinal gap 18, in order to fix its position at right angles to the longitudinal edges of the lower sheet 1 during its further transport.

A fourth flat sheet of material 22, which forms the bottom of the packing material, is brought out of an upper plane about the idle rollers 23 to lie upon the lower sheet 1 directly before the feeding site of the section 14, in order to be transported further jointly with the lower sheet 1 in the direction of the arrow 2. During its transfer from its upper supplying plane to the plane, in which it lies on the lower sheet 1, the flat sheet 22, in the case of the example shown in FIG. 1A on a vertical partial piece, is folded into a half tube 22', the one longitudinal side of which is formed by a folded edge 24 and the other longitudinal side of which is formed by the longitudinal edges 25 of the half tube 22', which are folded against one another and are kept free of connections. The half tube 22', which is placed on the lower sheet 1, is taken up by the triangular pockets 17' of the sections 14, in that the leading, open triangular pockets 17', as the sections 14 are being deposited on the lower sheet 1, take hold of the half tube 22', so that the folded edge 24 lies against the inner boundary-forming fold line 20 (FIG. 5) of the triangular pockets 17'.

During the further transport in the direction of the arrow 2, the lower sheet 1, together with the sections 14 and the half tube 22' placed upon it, arrive below the main sheet of material 3 as upper sheet, and the main material sheets 1 and 2, including the sections 14 and the half tube 22', are transported further jointly in the direction 2 to a welding device 26 with two welding dies, one above the other, between which the bottom-forming sheet of material 22 or the half tube 22', formed by the latter, is welded at its longitudinal edges 25 to the adjoining longitudinal edge 27.or 28 of the main sheets of material 1 and 3 to form a seam.

Figure 1B:
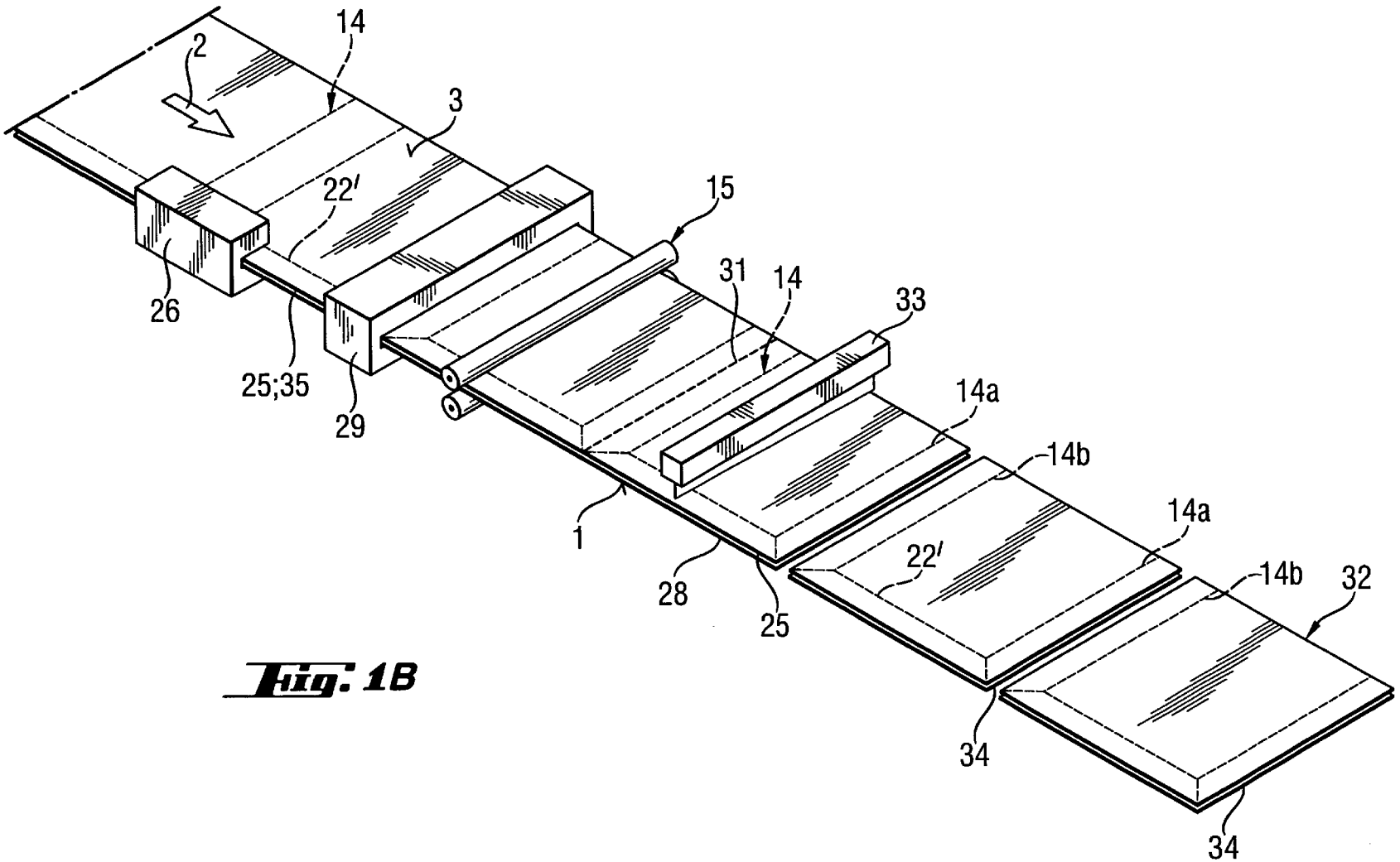

As the sheet composite is transported further in the conveying direction 2 by means of suitable conveying equipment, of which once again a pair of rollers 15 is shown in FIG. 1B, a further welding device 29, which has an upper and lower tool and extends transversely over the sheet composite, is reached. The sections 14*a* and 14*b* with the side folds are combined here to section 14 with two side folds and, along their longitudinal edges at the upper side 19*a* and the underside 19*b* of the section 14, with the respectively adjoining regions of the two main sheets of material 1 and 3 with the formation of parallel welded seams 31. Furthermore, the half tube 22' is welded with sections 14 to form a seam along the hypotenuses 21 of the tucked-in corner triangle 17 in the triangular pocket 17' of the sections 14.

After they are welded together with the two main sheets of material 1 and 3 and the half tube 21' in the region of their vertical longitudinal center plane containing the longitudinal gap 18, that is, also on the lower wall or underside 19*b*, lying opposite the gap 18, the sections 14 with two side folds are severed and, at the same time, assigned to the adjoining side edges of two adjoining packing materials 32. This severing takes place during the further transport of the sheet composites in the conveying direction 2 by means of a transverse cutting device 33, which severs also the half tube 22' between the hypotenuse edges 21 in the vertical center plane, containing the gap 18. In addition, during these severing processes, the edge-welded seams 31 are divided longitudinally into parallel edge-welded seams 34 at adjacent packing materials 32.

During the welding of the sheet of material 22, which forms the bottom, that is, of the half tube 22', with the two main sheets of material 1, 3 and the sections 14*a* and 14*b* with the side folds and, after the severing of the individual packing materials 32 from the sheet composite, a pattern of four bottom welding seams 34, 35 is formed, which are disposed at right angles to one another, go over into one another without interruptions and, as bottom of the packing material 32, form the boundary of a section of material 36, which has been severed from the half tube 22', and the main walls 37 of which, forming the front wall and the rear wall and lying opposite one another, are formed by the corresponding sections of the main sheets of material 1 and 3.

Figure 8:
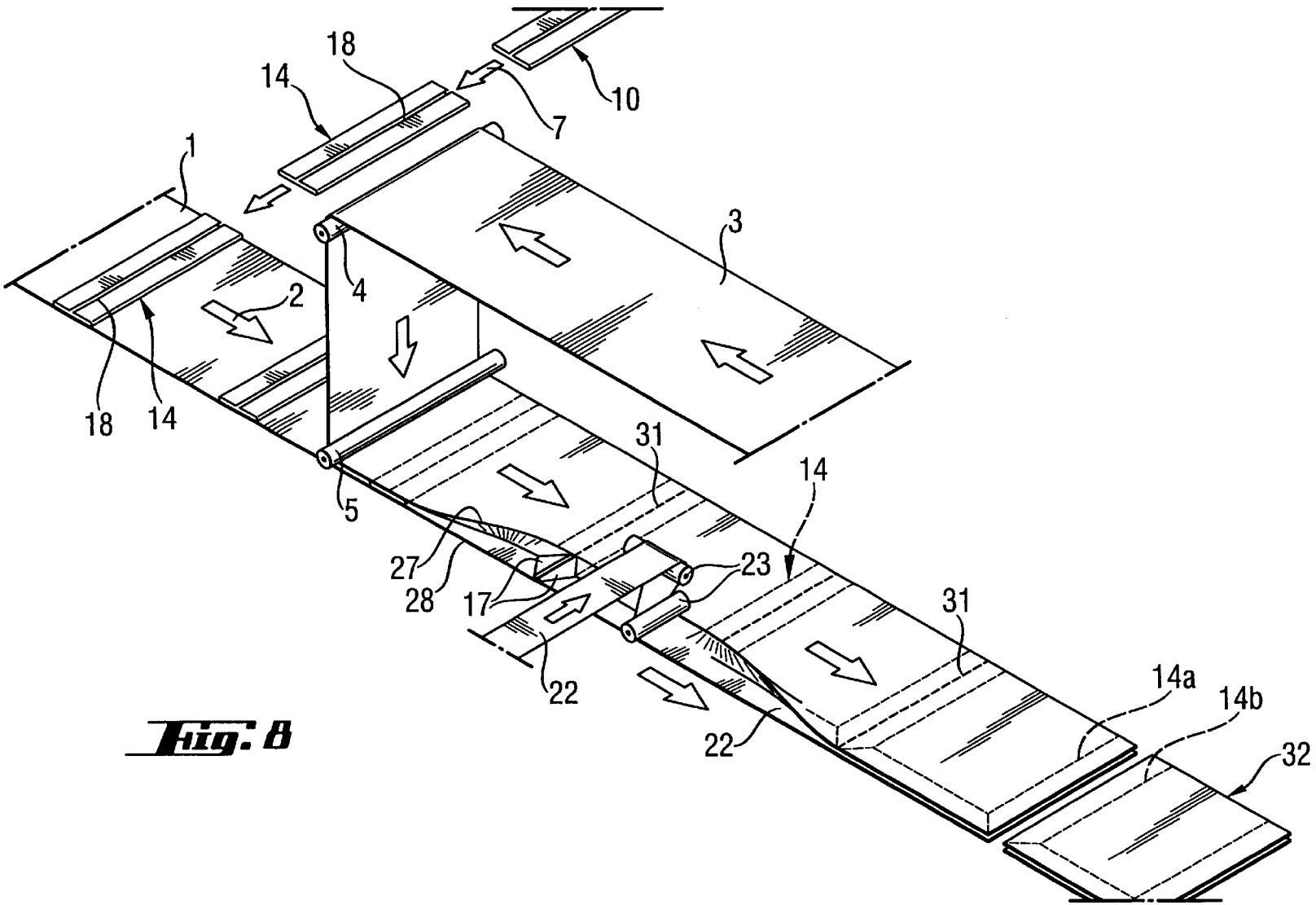
FIG. 8 shows a diagrammatic perspective representation of an apparatus for producing a packing material according to a further embodiment of the inventive method; in its measurements, the apparatus corresponds to that of FIG. 1A.

For the modified method, illustrated by means of FIG. 8, sections 14 with two side folds are once again severed from the web 10 with two side folds and, in the shape evident from FIG. 2, that is, without tucked-in corner triangles 17 being folded at the leading end, supplied as lower sheet to the main sheet of material 1, which is conveyed once again in the direction of the arrow 2. On the lower sheet 1, the sections 14, which are once again supplied in the direction of arrow 7 transversely or at right angles to the conveying direction, are placed, as are the sections 14 of the first example, at intervals corresponding to the desired width of the packing material 32 on the lower sheet 1 and fastened to this. The main sheet of material 3, as upper sheet from an upper plane, is brought together with the lower sheet 1 over the idle rollers 4 and 5 and, in turn, attached to the sections 14 already lying on the lower sheet 2.

During the further joint transport in the conveying direction 2, the longitudinal edge 27 of the upper sheet 3 is folded up relative to the longitudinal edge 28 of the lower sheet 1 with the end regions of the attached sections 14 with formation of the double tucked-in corner triangle 17 of the first example, which are formed here automatically along one of the fold lines corresponding to the transverse fold line 20.

The fourth sheet of material 22 is then placed as a flat sheet with a width corresponding to the unfolded longitudinal edges 27, 28 on the unfolded longitudinal edges 27, 28 with the tucked-in corner triangle 17. In so doing, the sheet of material 22 is conveyed from an upper supplying plane over the idle rollers 23 into the planes of the lower and upper sheets 1, 3. The folded longitudinal edge 28 of the upper sheet 3 is then folded back with inclusion of the tucked-in corner triangle 17 and enclosure of the sheet of material 22 on the edge 27 of the lower sheet 1 for a subsequent welding, that has already been described by means of FIG. 1B for the first example.

The attachment of the section 14 to the two main sheets of material 2, 3 is carried out in the region of the vertical longitudinal center plane of section 14, containing the longitudinal gap 18, by welding or preferably by the application of a hot melt or adhesive.

In other respects, the further steps of the method correspond to those of the version, described by means of FIGS. 1A and 1B. This is made clear by using the same reference symbols for identical or corresponding parts in the description of the method.

What I claim is:

1. A method of producing a package having first and second side walls joined to side fold sections and a bottom section joined to said first and second side walls and to said side fold sections, comprising transporting in a first direction (2) a continuum of first packaging material (1) which is to form said first side wall of said package, transporting in said first direction (2) a continuum of second packaging material (3) which is to form said second side wall of said package, transporting in a second direction (7) a plurality of individual lengths of third packaging material (14) having overlapping folded parts (12) which are to form the side fold sections of said package, transporting in said first direction (1) a continuum of fourth packaging material (21') having overlapping folded parts which are to form the bottom of said package, disposing said fourth packaging material (21') in at least a partial superimposed relationship with said first packaging material (1), disposing said first and fourth packaging materials (1, 21') in at least a partial superimposed relationship with individual lengths of said third packaging material (14), transporting said at least partial superimposed first, third and fourth packaging materials (1, 14, 21') in said first direction (1) into at least a partially superimposed relationship with said second packaging material (3), joining at least parts of said at least partially superimposed first, second, third and fourth packaging material (1, 3, 14, 21'), and severing said first, second, third and fourth packaging material (1,3, 14, 21') along a severing line extending generally transversely of said first direction (1) to thereby provide a plurality of packages each formed by severed lengths of first and second packaging materials (1,3) which form the first and second side walls of the package, by severed lengths of third packaging material (14) which form said side fold sections of the package, and by severed lengths of fourth packaging material (21') which form the bottom of said package.

2. A method of producing a package according to claim 1 comprising forming said third packaging material (14) by folding a flat unfolded continuum of packaging material (6) along two spaced fold lines (11).

3. A method of producing a package according to claim 1 further comprising forming said third packaging material (14) by transporting a flat unfolded continuum (6) of packaging material and folding said flat unfolded continuum (6) along two parallel fold lines (11) to provide two folded side parts (12) each of which overlap an intermediate part.

4. A method of producing a package according to claim 3 wherein the last said folding step includes disposing longitudinal edges of said two folded side parts (12) juxtaposed to one another.

5. A method of producing a package according to claim 4 wherein the last said disposing step comprises providing a longitudinally extending gap (18) between said longitudinal edges of said two folded side parts (12).

6. A method of producing a package according to claim 1 further comprising forming double tucked-in corners at a leading longitudinal end portion (19) of the individual lengths of third packaging material (14).

7. A method of producing a package according to claim 6 wherein the last said forming step comprises forming four tucked- in triangular portions (17) each having superimposed triangular sections joined at a fold line (20).

8. A method of producing a package according to claim 1 wherein said overlapping folded parts (12) of said lengths of third packaging material (14) have substantially equal widths (t) measured perpendicular to said second direction (7), further comprising a pocket folding step of folding a leading end portion (19) of said individual lengths of third packaging material (14) along transverse fold lines (20) extending perpendicular to said second direction (7) and disposed at a distance from a leading longitudinal end of each individual length of third packaging material (14) a distance substantially equal to said width (t) of said overlapping folded side parts (12).

9. A method of producing a package according to claim 8 wherein said pocket folding step comprises forming four right angle folded portions (17) on said third packaging material (14), said pocket folding step further comprising providing each of said right angle folded portions (17) with two equal sides joined to a third hypotenuse side with the lengths of said two equal sides being equal to the width (t) of said two overlapping folded parts (12) of said lengths of third packaging material (14), said pocket folding step further comprising disposing the third hypotenuse side of each right angle folded portion (17) at the leading longitudinal end of said lengths of third packaging material (14).

10. A method of producing a package according to claim 9 wherein said pocket folding step comprises disposing one equal side (20) of each right angle folded portion (17) in a direction perpendicular to said second direction (7) and disposing the other side of each right angle folded portion (17) in a direction parallel to said second direction (7).

11. A method of producing a package according to claim 9 wherein each of said right angle folded portions (17) comprise two superimposed right angle parts, one equal side of each right angle part being formed by an inner fold line (20).

12. A method of producing a package according to claim 9 wherein said pocket folding step comprises disposing pairs of said right angle folded portions (17) in superimposed array to form receiving pockets (17') between the pairs of superimposed pairs of right angle folded portions (17).

13. A method of producing a package according to claim 12 wherein said step of transporting said fourth packaging material (21') comprises transporting said fourth package material (21') into said receiving pockets (17').

14. A method of producing a package according to claim 1 wherein said separate lengths of third packaging material (14) each have a leading longitudinal end portion, and further comprising a pocket folding step of folding each leading end portion to form pockets (17') having overlapping sections joined at an inner fold (20).

15. A method of producing a package according to claim 14 comprising inserting at least portions of said fourth packaging material (21) into said pockets (17') at said lending end portion of said separate lengths of third packing material (14).

16. A method of producing a package according to claim 14 comprising supplying said continuum of fourth packaging material (22) with its overlapping folded parts having first juxtaposed longitudinal edges (25) free of one another and second juxtaposed longitudinal edges joined to one another along a longitudinal fold line (22'), inserting at least portions of said fourth packaging material (21') into said pockets (17'), said inserting step comprising disposing said longitudinal fold line (22') of said fourth packaging material in a position juxtaposed to said inner fold (20) of said pockets (17').

17. A method of producing a package according to claim 1 comprising initially supplying said forth packaging material (22) as a continuum of supplied flat packaging material moving in a direction transverse to said first direction and folding said continuum of flat supplied flat packaging material (22) along its longitudinal extent to form a continuum of overlapping sections of fourth packaging material (21') moving in said first direction.

18. A method of producing a package according to claim 1 comprising initially supplying said forth packaging material (22) as a continuum of supplied flat packaging material (22), and folding said continuum of flat supplied package material along its longitudinal extent to form a continuum of overlapping sections of fourth packaging material (21').

19. A method of producing a package according to claim 18 wherein said initial supplying step comprises transporting said fourth packaging material (22) as a continuum of supplied flat packaging material in a transverse direction relative to said first direction and changing the direction of transport of said continuum of supplied flat packaging material (22) from said transverse direction to said first direction (1) during said folding step.

20. A method of producing a package having first and second side walls joined to side fold sections and a bottom section joined to said first and second side walls and to said side fold sections, comprising transporting in a first direction (2) a continuum of first packaging material (1) which is to form said first side wall of said package, transporting in said first direction (2) a continuum of second packaging material (3) which is to form said second side wall of said package, transporting in a second direction (7) a third packaging material (14) having overlapping folded parts (12) which is to form the said side fold sections of said package, transporting in said first direction (1) a continuum of fourth packaging material (22) having overlapping folded parts which are to form the bottom of said package, disposing said third packaging material (14) in at least a partial superimposed relationship with said first packaging material (1), disposing said first and third packaging material (1, 14) in at least a partial superimposed relationship with said second packaging material (3), transporting said at least partially superimposed first, second, and third packaging materials (1, 3, 14) in said first direction (1) into at least a partially superimposed relationship with said fourth package material (22), joining at least parts of said at least partially superimposed first, second, third and fourth packaging material (1, 3,14, 22), and severing said first, second, third and fourth packaging material (1,3, 14, 22) along a severing line extending generally transversely of said first direction (1) to thereby provide a plurality of packages each formed by severed lengths of first and second packaging materials (1,3) which form the first and second side walls of the package, by severed lengths of third packaging material (14) which forms said side fold sections of the package, and by severed lengths of forth packaging material (22) which form the bottom of said package.

21. A method of producing a package according to claim 20 comprising providing said third packaging material (14) as a continuum of third package material and severing said continuum of third packaging material into said separate lengths of third package material.

22. A method of producing a package according to claim 20, comprising disposing separate lengths of said third packaging material (14) at successive spaced intervals on said continuum of first packaging material (1).

23. A method of producing a package according to claim 20 wherein said joining step comprises affixing separate lengths of third packaging material (14) to juxtaposed sections of said first packaging material (1) and to juxtaposed sections of second packaging material (3) in which said juxtaposed sections are spaced at intervals along said first and second packaging materials (1,3), said severing step comprising severing each separate length of third packaging material (14) along its longitudinal length and severing said first and second packaging materials (1,3) along said respective joined juxtaposed sections.

24. A method of producing a package according to claim 23 wherein said joining step further comprises attaching said fourth packaging material (22) to sections of said first, second and third packaging materials, (1, 3, 14) said severing step further comprising severing said fourth packaging material (22).

25. A method of producing a package according to claim 23 wherein said severing step comprises severing said third packaging material (14) along a substantially longitudinal extending bisecting line.

26. A method of producing a package having first and second side walls joined to side fold sections and a bottom section joined to said first and second side walls and to said side fold sections, comprising transporting in a first direction (2) a first packaging material (1) which is to form said first side wall of said package, transporting in said first direction (2) a second packaging material (3) which is to form said second side wall of said package, transporting in a second direction (7) a third packaging material (14) having overlapping folded parts (12) which is to form said side fold sections of said package, transporting in said first direction (1) a fourth packaging material having overlapping folded parts which are to form the bottom of said package, disposing said first, second, third and fourth packaging material in at a least a partial superimposed relationship, and severing said first, second, third and fourth packaging material along a severing line extending generally transversely of said first direction (1) to thereby provide a plurality of packages each formed by severed lengths of first and second packaging materials (1,3) which form the first and second side walls of the package, by severed lengths of third packaging material (14) which form said side fold sections of the package, and by severed lengths of fourth packaging material which form the bottom of said package.

27. A method of producing a package according to claim 26 wherein said third packaging material (14) has a leading end portion, further comprising forming at said leading end portion four double tucked in triangular portions (17) each having superimposed triangular sections joined at a fold line (20).

28. A method of producing a package according to claim 26 wherein said third packaging material (14) has a leading end portion, said overlapping folded parts (12) of said third packaging material (14) have substantially equal widths (t) measured perpendicular to said second direction (7), further comprising a pocket folding step of folding the leading end portion of said third packaging material (14) along transverse fold lines (20) extending perpendicular to said second direction (7) and disposed at a distance from the leading longitudinal end (19) of said third packaging material (14) a distance substantially equal to said width (t) of said overlapping folded parts (12).

29. A method of producing a package according to claim 28 wherein said pocket folding step comprises forming four right angle folded portions (17) on said third packaging material, said pocket folding step further comprising providing each of said right angle folded portions (17) with two equal sides joined to a third hypotenuse side with the lengths of said two equal sides being substantially equal to the width (t) of said two overlapping folded parts (12) of said third packaging material (14), said pocket folding step further comprising folding the third hypotenuse side of each right angle folded portion (17) at the leading longitudinal end of said lengths of third packaging material (14).

30. A method of producing a package according to claim 29 wherein said pocket folding step comprises disposing one equal side (20) of each right angle folded portion (17) in a direction perpendicular to said second direction (7) and disposing the other side of each right angle folded portion (17) in a direction which is parallel to said second direction (7).

31. A method of producing a package according to claim 29 wherein each of said right angle folded portions (17) comprise two superimposed right angle parts, one side of each right angle part being formed by an inner fold line (20).

32. A method of producing a package according to claim 29 wherein said pocket folding step comprises disposing pairs of said right angle folded portions (17) in superimposed array to form receiving pockets between the pairs of superimposed pairs of right angle folded portions.

33. A method of producing a package according to claim 32 wherein said step of transporting said fourth packaging material comprises transporting said fourth package material into said receiving pockets.

34. A method of producing a package according to claim 26 wherein said third packaging material (14) has a leading end portion, further comprising a pocket folding a step of forming pockets with overlapping sections at said leading end portion of said third packaging material, said pocket folding step being performed prior to the step of disposing said third packaging material (14) in at least a partial superimposed relationship with said first, second and fourth packaging material.

35. A method of producing a package according to claim 26 wherein said step of disposing said first, second, third and fourth packaging materials in at least a partial superimposed relationship includes initially disposing said third packaging material in at least a partial superimposed relationship with said first packaging material, said third packaging material having a leading end portion, further comprising a pocket forming step of forming pockets with overlapping sections at said leading end portion of said third packaging material, said pocket forming step being performed after said third packaging material has been disposed in at least a partial superimposed relationship with said first packaging material.

* * * * *